United States Patent [19]

Murphy et al.

[11] 4,051,939

[45] Oct. 4, 1977

[54] COIN OR TOKEN OPERATED AMUSEMENT DEVICE

[75] Inventors: Francis T. Murphy, Glenview; Peter Sagan, Chicago; Martin B. Rosenthal, Park Forest; Alfred R. Ostrowski, Oak Forest, all of Ill.

[73] Assignee: The Seeburg Corporation of Delaware, Chicago, Ill.

[21] Appl. No.: 400,726

[22] Filed: Sept. 27, 1973

[51] Int. Cl.[2] ..... A63F 5/04

[52] U.S. Cl. ..... 194/10; 273/143 R

[58] Field of Search ..... 194/76, 10, DIG. 11; 273/143 R, 138 A, 143 A, 143 D

[56] References Cited

U.S. PATENT DOCUMENTS

| | | | |
|---|---|---|---|
| 3,642,287 | 2/1972 | Lally et al. | 273/143 R |
| 3,751,040 | 8/1973 | Carey | 273/143 R |

*Primary Examiner*—Stanley H. Tollberg

[57] ABSTRACT

The amusement device in which a plurality of symbol bearing wheels are rotated and then stopped, and wherein feelers are then permitted to move toward the axis of rotation to sense the combination of symbols appearing in a straight line. An electrical circuit is provided and operates in response to the position of the feelers and the number of coins or tokens used to determine whether a player has won, and, if so, to what extent that player has won.

7 Claims, 16 Drawing Figures

COIN OR TOKEN OPERATED AMUSEMENT DEVICE

BACKGROUND OF THE INVENTION

This invention relates to amusement devices wherein various combination of symbols on a plurality of freely rotative wheels may be used to determine to what extent a player has won.

It is an object of this invention to provide a novel amusement device in which the actuating and control elements are simplified as contrasted with the devices of the prior art.

It is another object of this invention to provide a novel amusement device in which the actuating and control elements are arranged to permit access to whereby manufacture and service is rendered more easily done.

It is still another object of this invention to provide a novel amusement device which is capable of being operated in a number of different modes permitting a player to determine the extent he has won in the event a winning combination of symbols results from playing of the device.

A further object of this invention is to provide a novel amusement device including a numbr of motor driven spinning wheels wherein the period of time during which the wheels are driven is subject to random variations in time.

BRIEF SUMMARY OF THE INVENTION

The foregoing and other objects of the invention are achieved in one embodiment by the provision of a plurality of freely rotatable wheels set into motion by a motor actuated and means then permitted to rotate freely until stopped after a fixed time. A corresponding number of movable feelers to which are connected electrical switch means are then actuated to move to the axis of rotation engage stops carried on stop discs associated with each wheel. In one aspect the invention includes electrical control means effective to vary the rotation period.

BRIEF DESCRIPTION OF THE DRAWINGS

The invention itself is set forth in the claims appended hereto and forming a part of this specification while an understanding of the structure and mode of operation of an embodiment thereof may be had by reference to the detailed description taken in conjunction with the drawings in which:

DETAILED DESCRIPTION

Figure 1:
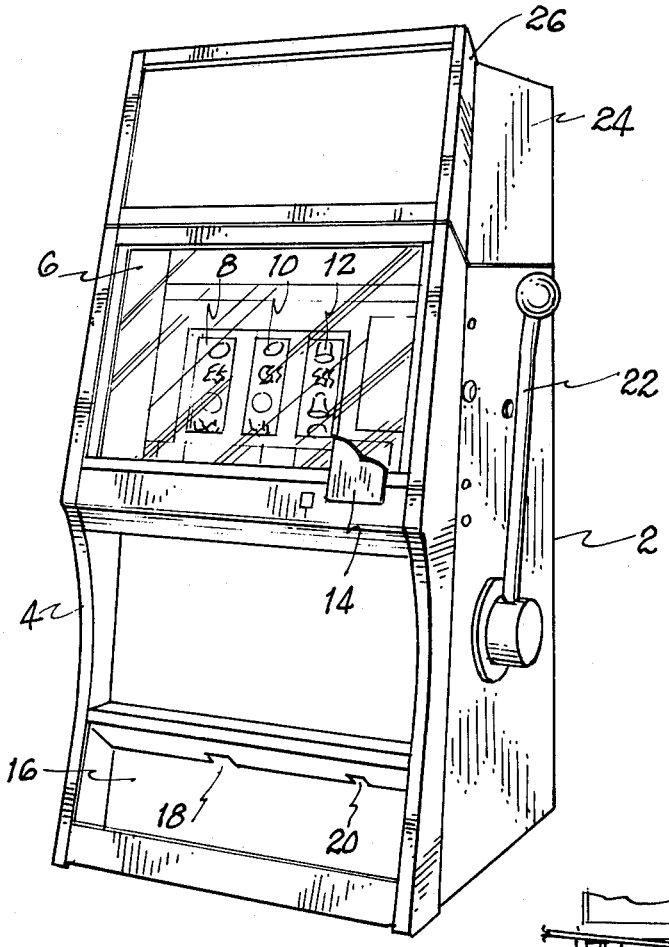
FIG. 1 is a perspective illustration of an amusement device in accordance with the invention.

As may be seen in FIG. 1 an embodiment of the invention may be housed in a case 2 provided a door 4 hinged so it is swung open horizontally to provide access to the device. The door is provided with a transparent viewing surface 6 exposing the surface of three rotatable wheels 8, 10 and 12 to one using the device. A slot to receive coins or tokens whereby the device may be used is provided at 14 while a receptacle 16 at the bottom of the door includes an opening 18 to permit the discharge of coins or tokens which may be won by the user if the device is operated to permit such a mode of operation. Another opening 20 into the receptacle 16 is provided for the discharge of improper coins or tokens, the use of which may be attempted. It is contemplated that conventional improper coin or token rejectors may be incorporated into the device so as to preclude the operation of the device by such means. A handle 22 is provided for actuation by the user after a coin or token or a desired number of coins or tokens have been inserted in the slot 14 and it is desired to play the game.

An upper portion 24 of the case 2 may be utilized to house the electrical control circuits forming a part of the invention and access thereto may be provided by a door 26. In addition the panel of the door 26 may be used to permit viewing if display lights indicate coins played, winning combination and the like.

Figure 2:
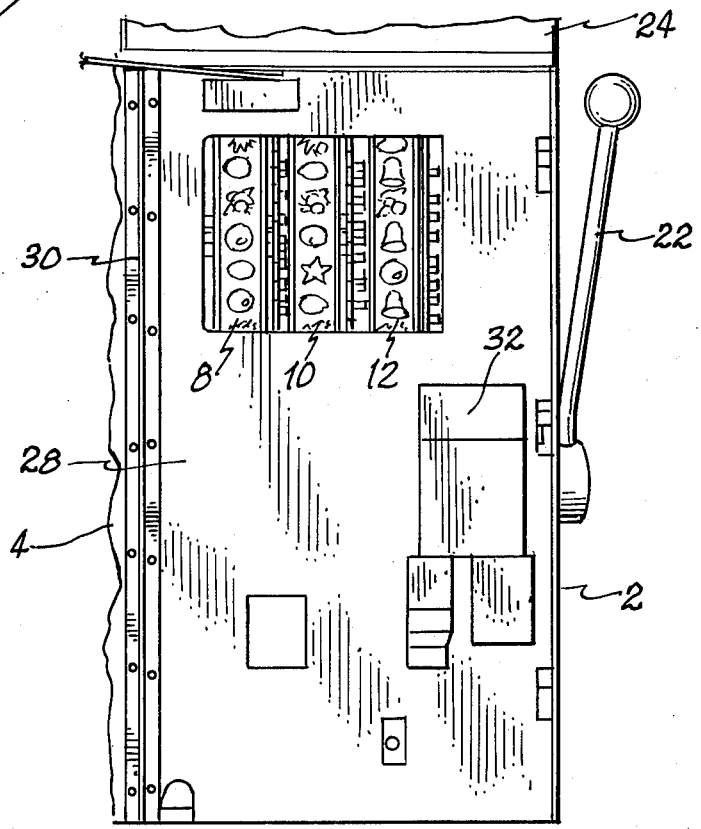
FIG. 2 is a front view of the device of FIG. 1 with the door open.

In FIG. 2 it may be seen that in order to control access to the mechanism and control circuits an inner door 28 may be provided to be exposed only after the door 4 has been opened. The door 28 may be mounted on a piano hinge 30 and provided with a lock as may the door 4. An opening 32 in the door 30 permits coins or tokens inserted through the slot 14 to enter the coin or token receiving and rejector mechanism (not shown).

Figure 3:
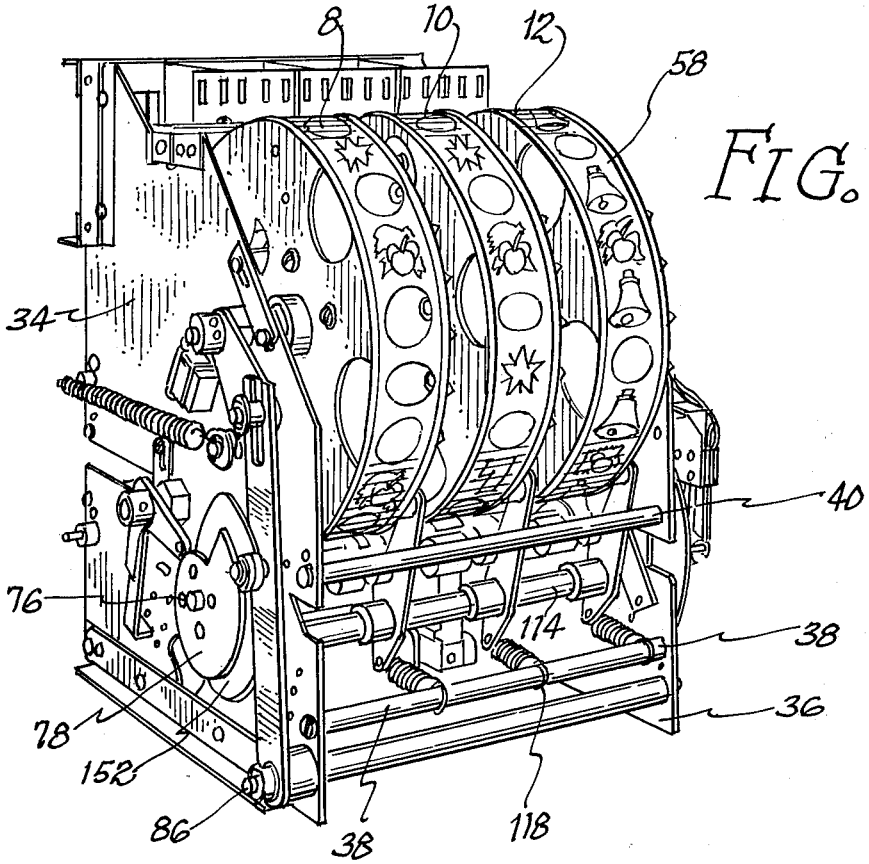
FIG. 3 is a perspective illustration particularly showing the left-hand side of an embodiment of the invention.
Figure 4:
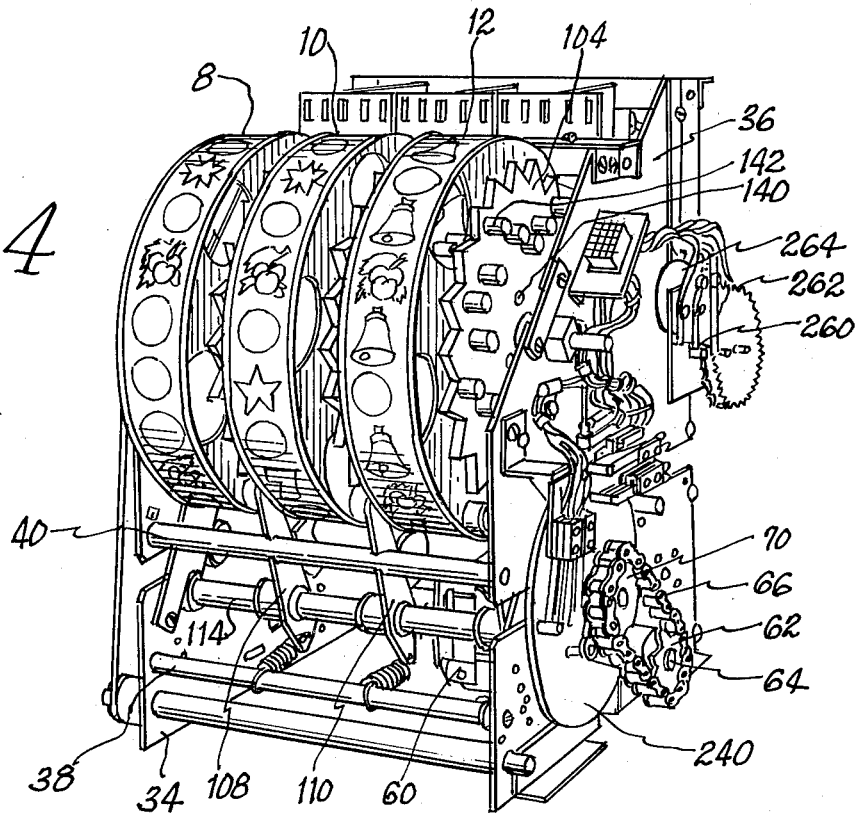
FIG. 4 is a perspective illustration particularly showing the right-hand side of the embodiment of FIG. 3.
Figure 9:
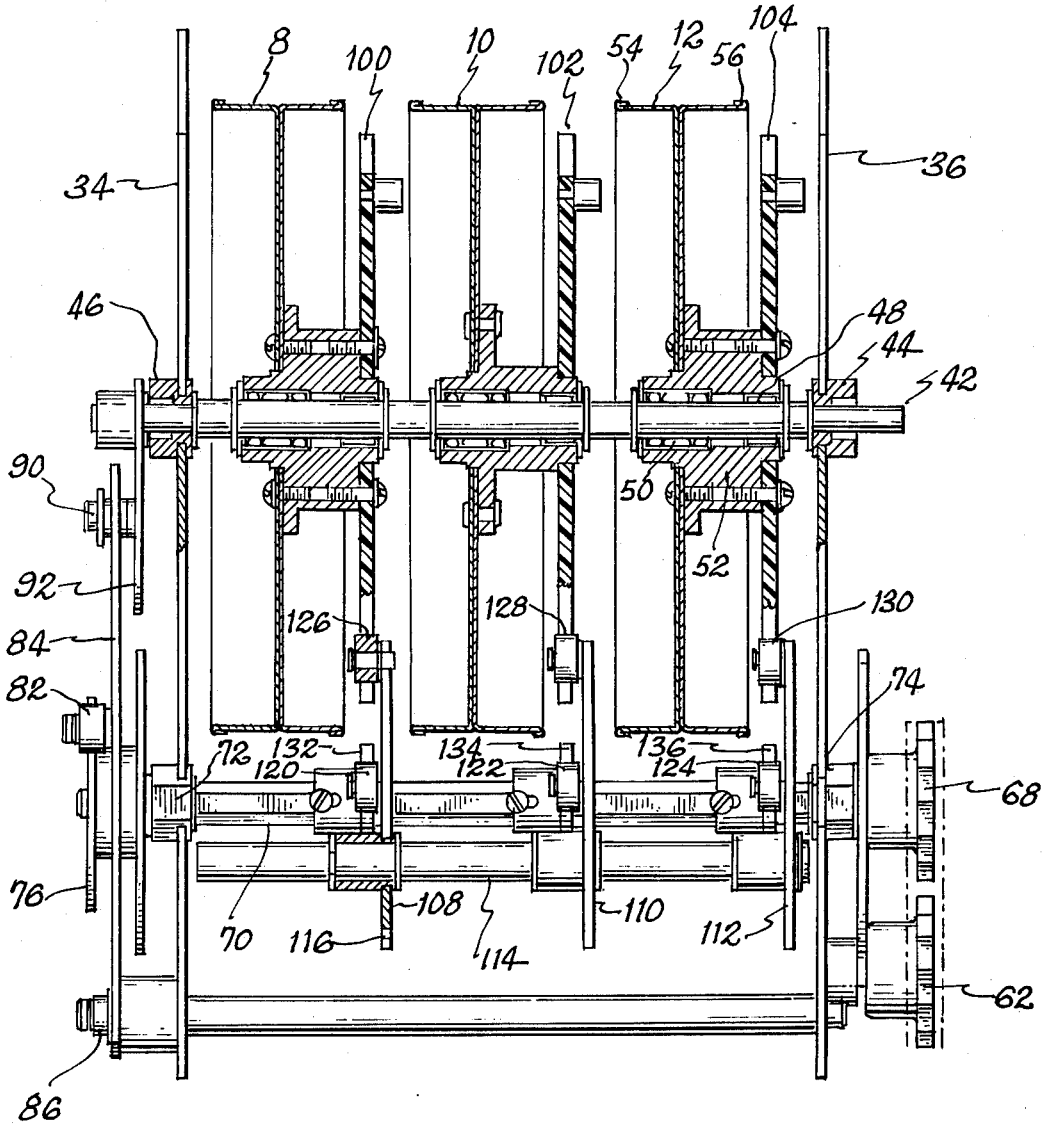
FIG. 9 is a view partially in section of the front of the embodiment of FIG. 3.

Referring now to FIGS. 3, 4 and 9 the general arrangement of the embodiment illustrated will now be described. Thus, the device includes a pair of spaced side walls 34 and 36 maintained apart by spacer bars 38 and 40. A wheel shaft 42 extends through the walls 34 and 36 and is rotatable by virtue of its mounting in bushings 44 and 46. Each wheel 8, 10 and 12 is mounted on the shaft 42 for free rotation thereon in one direction by the provision of bearings 48 and one way clutches 50 provided in hub 52 of each wheel. Therefore, when the wheel shaft 42 is rotated in one direction the wheels 8, 10 and 12 will rotate in that same direction, and when the wheel shaft stops the wheels will continue to rotate in that direction until they stop or are stopped.

Each wheel is formed from lightweight metal, preferably from two pieces for ease of fabrication and is provided with crimped over guides 54 and 56 on either side to receive a strip 58 bearing a variety of different symbols. When the wheels are rotated and then stopped the combination of symbols appearing in a line which may be that indicated in a viewing arc designated at 60 in FIG. 5 will determine whether the player has won and to what extent. It should be understood, as will be apparent from the subsequent description that more than one scoring line may be used and combinations of symbols in those lines used to determine if the player has won and to what extent.

In order to set the wheels 8, 10 and 12 in motion a control motor 60 is mounted on the side wall 36 and carries a sprocket 62 on its output shaft 64. A chain 66 trained over the sprocket 62 drives a sprocket 68 secured to a drive shaft 70 extending across the device and supported in bearings 72 and 74 mounted in the side walls 34 and 36, respectively.

Mounted on the end of the drive shaft 70 adjacent the side wall 34 is a wheel cam 76 having rise portion 78 (see FIG. 5) of increasing radius from its center of rotation and a sharp offset 80. A cam following roller 82 is carried a link 84 pivoted on the side wall 34 at 86. A slot 88 on the free end of the pivoted link 84 engages a stud or boss 90 on a wheel lever 92. Another stud or boss 94 on the wheel lever 92 serves as an anchor for a coil spring 96 which is secured at its other end 98 to the side wall 34.

Figure 5:
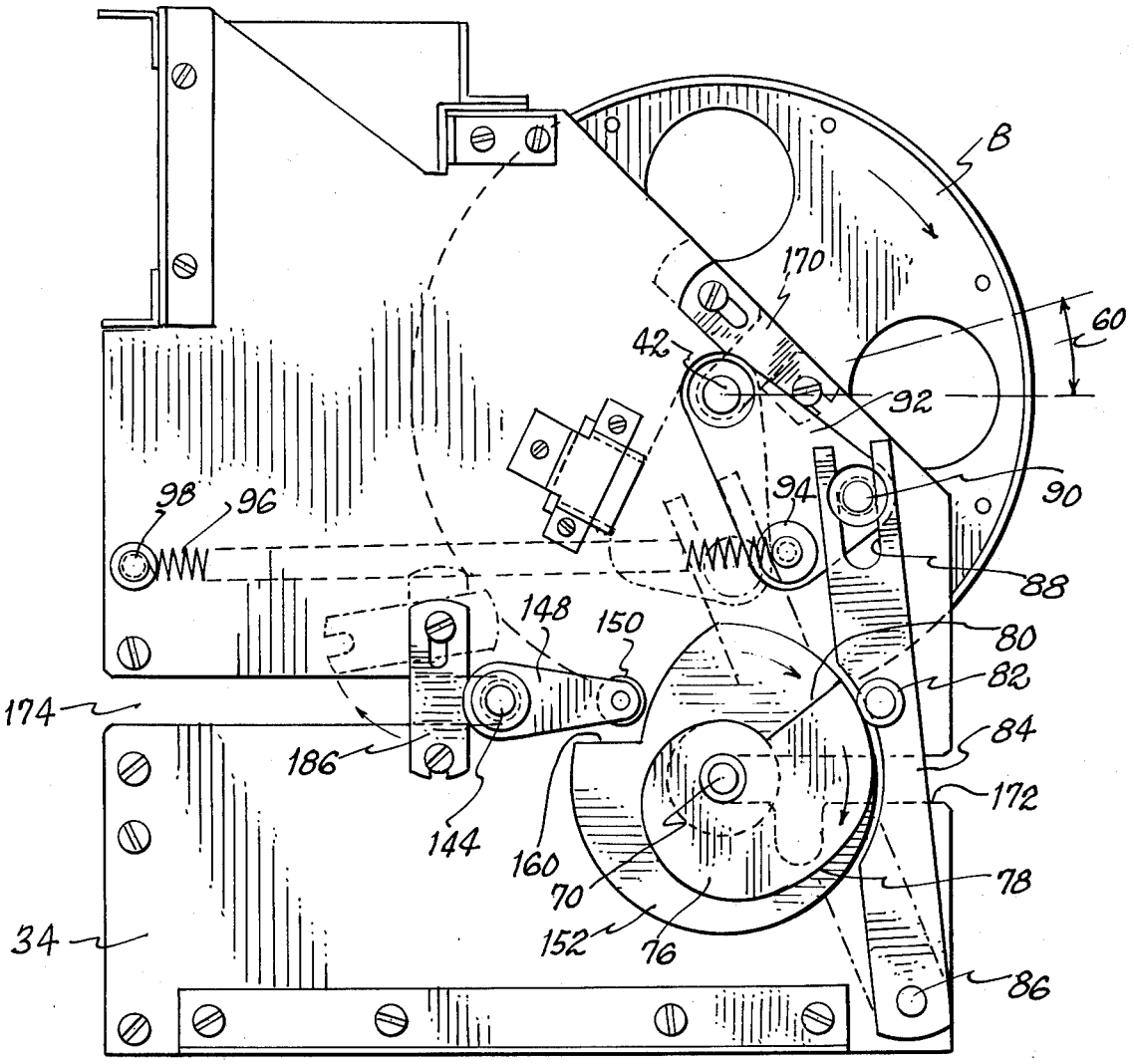
FIG. 5 is a side view of the embodiment of FIG. 3.

In operation when the control motor 60 is operated to rotate the shaft 70 in the clockwise direction as indicated by the arrow in FIG. 5, the wheel cam 76 is rotated in the same direction until the cam follower 82 clears the rise portion 78 of the wheel cam 76. Prior to that the link 84 had been pivoted in the clockwise direction causing the wheel lever 92 and the wheel shaft 42 to be rotated in the counterclockwise against the force of the spring 96. This action may be characterized as the cocking or setting of the wheel rotating means just prior to the playing of the device. It should be noted that during cocking phase the wheels 8, 10 and 12 were not rotated with the shaft 42 because of the action of the one way clutches 50.

Upon the rotation of the wheel cam 76 to a point where the follower 82 passed the offset 80 the link 84 is no longer restrained from counterclockwise movement so that force of the spring 96 is effected to rotate the wheel lever 92 clockwise to its dotted line position and the link 84 is rotated counterclockwise to its dotted line position by virtue of the engagement of the stud 90 in the slot 88. The spring 96 is selected to have a restoring force sufficient to impart substantial torque to the wheel lever 92 and, therefore, the wheel shaft. That torque in turn transmitted to the wheels 8, 10 and 12 by the action of the one way clutches 50 and they are, therefore, started in rapid motion in the clockwise direction. Once set in motion the wheels continue to rotate until stopped.

After the wheels have been rotated because the cam follower 82 has moved passed the offset 80 the control motor 60 continues and cam follower now riding on the rise portion 78 of ever increasing radius starts to move the link 84 clockwise to recock the wheel rotating mechanism for the next cycle of play.

In order to stop the rotation of the wheels and to insure that they stop with the symbols, in whatever combination chance brings them to, in a straight line a wheel stop mechanism is provided. This is best shown in FIGS. 3, 4, 7, 8 and 9.

Associated with each wheel 8, 10 and 12 are star detent plates 100, 102 and 104, respectively. As seen in FIG. 9 each star plate is attached to the hub 52 of its associated wheel so as to rotate therewith. Formed around the periphery of each star plate are a plurality of teeth 106 which are shown as pointed or triangular but may be rounded or of any desired shape. A plurality of stop levers 108, 110 and 112, one for each star plate 100, 102 and 104, respectively, are rotatably mounted on a stop lever bar 114 extending transversely of the devices and supported by the side walls 34 and 36. An opening 116 in each stop lever receives one end of a bearing spring 118 anchored to its other end to the spacer bar 38 so that each stop lever is biased in the clockwise direction toward engagement with its associated star plate.

Mounted on each stop lever are cam follower rollers 120, 122 and 124 and rollers 126, 128 and 130 for engagement in the spaces between the teeth 106 of the star plates. Thus, assuming the stop levers are free to rotate toward the star plates they will be urged in that direction by their springs 118 and upon engagement with the plates be effective to prevent or stop the rotation of the wheels.

Cooperating with each cam follower 120, 122 and 124 are stop cams 132, 134 and 136, respectively. Each stop cam is formed to have a rise or high portion of a different arc so that when they rotate each rise portion will be in engagement with its associated follower for different periods of time. As is best seen in FIG. 9 each stop cam is mounted on the shaft 70 driven by the control motor 60 so as to be rotated thereby. By reference to FIG. 8 it may be seen that the stop cam 132 associated with the stop lever 108 and, therefore, the wheel 8 has a high portion 138 extending only over a relatively small portion of its circumference. The stop cam 134 has a high portion extending a greater distance around its circumference. Each of the stop cams 132, 134 and 136 are, therefore, dimensioned and positioned on the drive shaft 70 in order to permmit the wheels 8, 10 and 12 to be stopped in that order.

Therefore, as the control motor 60 is energized to cause the drive shaft 70 to rotate the first event to take place is to cause the cam follower 82 to go past the offset 80 of the wheel cam 76 and the wheels to be rotated as described. At a fixed time after that the cam 132 has been rotated to the point where the cam follower 120 goes past the high portion 138 of that cam and the spring 118 acting on the stop lever 108 is effective to urge the stop lever together with its roller 126 toward the star plate 100. The roller 126 engaging in any of the spaces between the teeth 106 of the star plate 100 causes the wheel 8 to be stopped with one of the symbols appearing thereon in the line indicated above, it being understood that the wheel 8 had been spinning freely on the wheel shaft 42 up to that point. After a predetermined time fixed by the extent of the high portion of the stop cam 134, the cam follower 122 is no longer restrained by the high portion and the spring 118 associated with the stop lever 110 is effective to cause the stop lever 110 to move the roller 128 into engagement with the star plate 102 stopping the wheel 10. At a still later time the high portion 140 of the cam 136 has moved past the cam follower at 124 and the stop lever 112 and roller 120 are effective to stop the wheel 12. Thus, the wheels are stopped in order from left to right as shown in the drawing.

Upon the stopping of the wheel it is now desired to determine if the combination of symbols now appearing in the viewing line are a winning combination. This is achieved by the provision of feeler arms 140 associated with each of the wheels and cooperating with prepositioned lugs extending from each of the star plates 100, 102 annd 104. Each star plate has provided therein a plurality of holes 140 into which transversely extending lugs 142 may be prepositioned. The holes 140 extend in radial lines from the center of each star plate and a lug is placed in a hole on a particular line in a given radius depending whether or not a symbol associated with that particular lug is intended in any play of the game to be part of a winning combination of symbols. Each feeler arm is fixedly mounted on a feeler shaft 144 which extends transversely of the device and is mounted in the side walls 34 and 36. A feeler 146 is formed on each feeler arm at the appropriate time in a cycle engages and is stopped by one of the lugs 142.

Secured to the end of the feeler arm shaft 144 adjacent the side wall 34 is a lever 148 carrying a roller cam follower 150. Fixedly mounted on the drive shaft 70 adjacent the wheel cam 76 is a feeler cam 152. The lower end of each feeler arm 140 is provided with a hook 154 to which is secured one end of a coil spring 156, the other end of which is anchored to a spacer shaft 158 extending between the side walls 34 and 36. As may be best seen in FIG. 7, therefore, the spring 156 biases its associated feeler arm in the counterclockwise direction toward its associated star plate.

Figure 7:
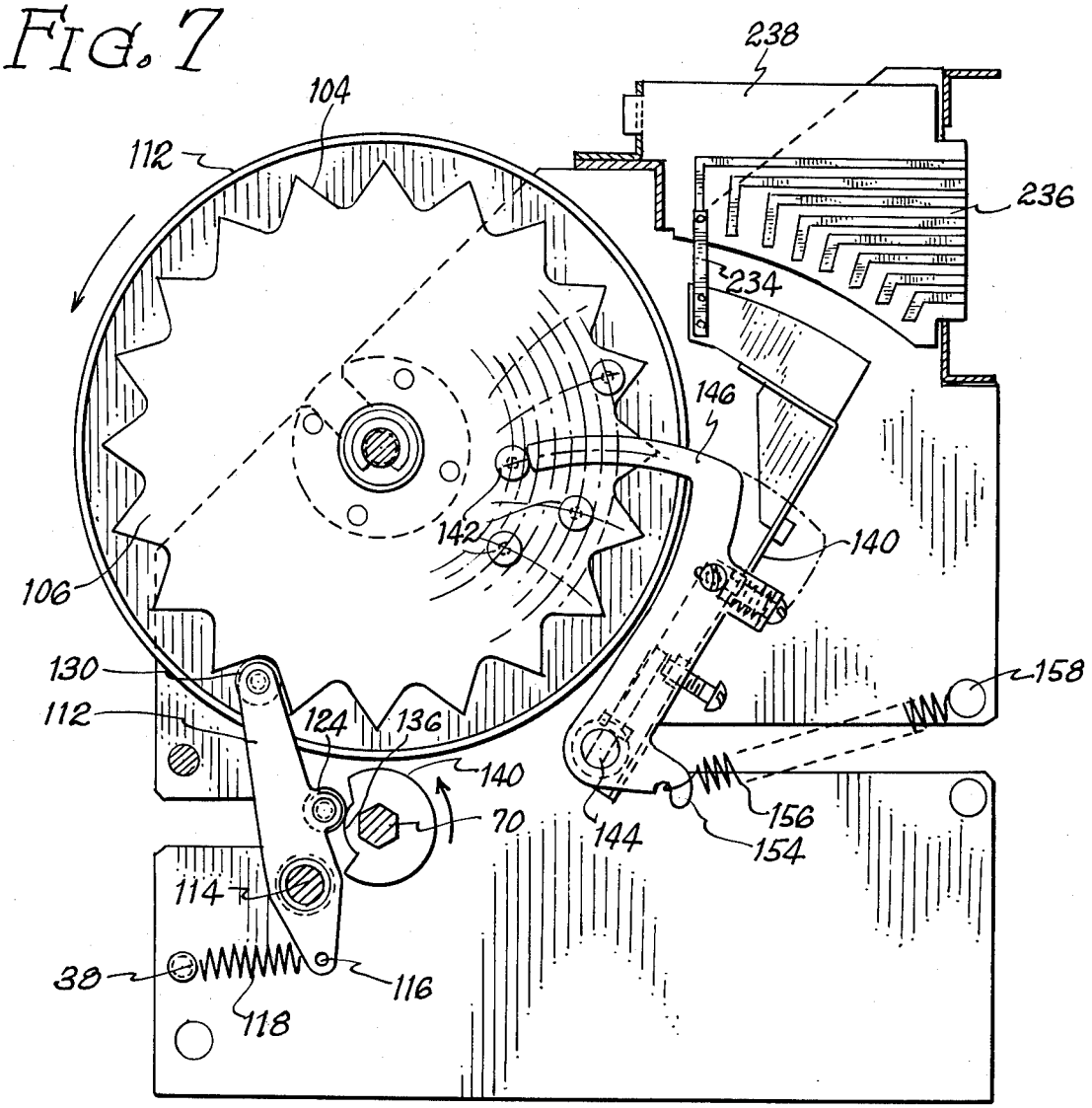
FIG. 7 is a view along a section of the embodiment of FIG. 3 taken near the right-hand side.
Figure 8:
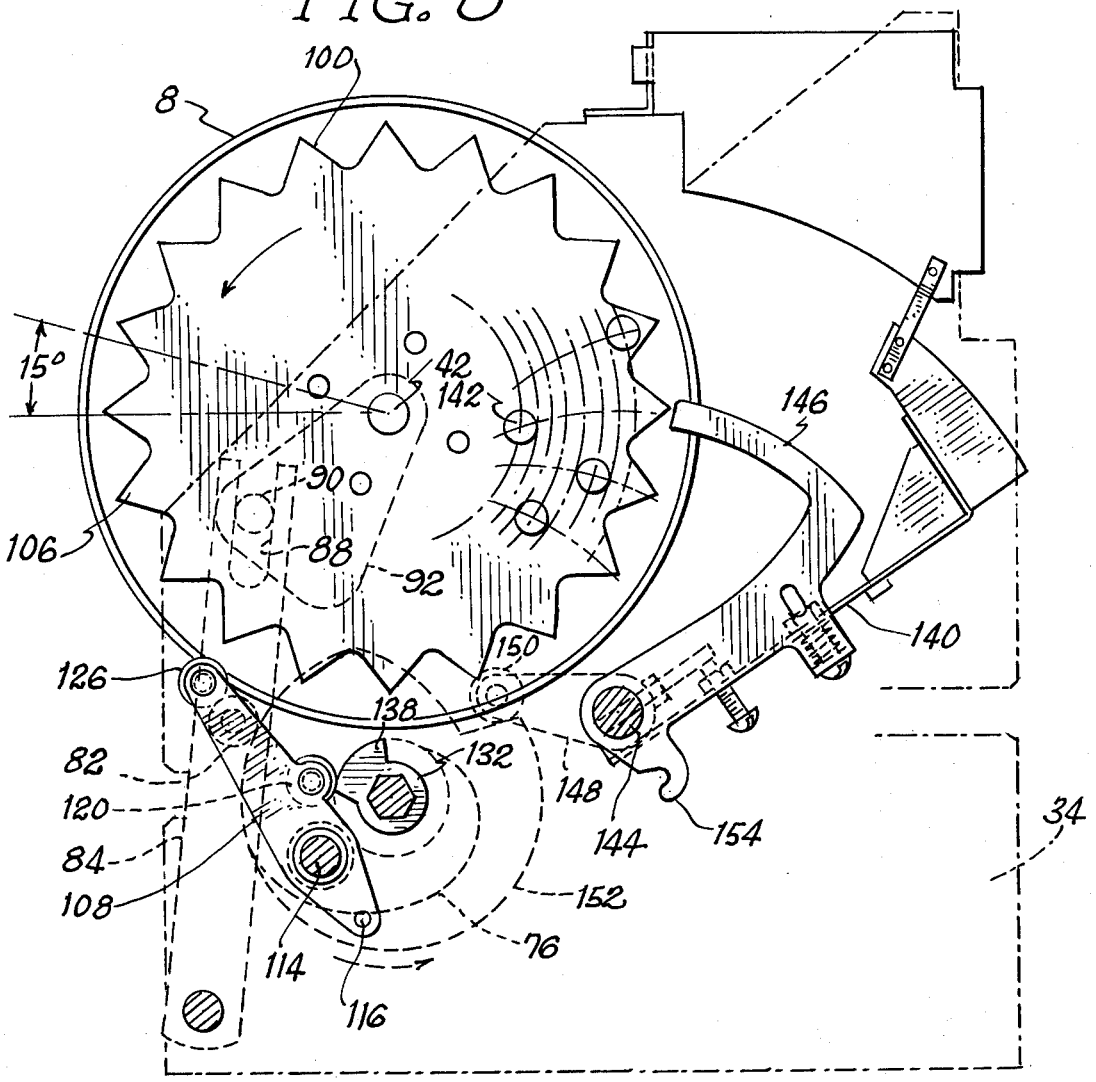
FIG. 8 is a view along a section of the embodiment of FIG. 3 taken near the left-hand side.

The feeler cam 152, as may be seen in FIG. 5, rotates in the clockwise direction along with the shaft 70 and wheel cam 76. Therefore, at the beginning of a cycle the roller 150 is first engaged by an offset 160 on the cam 152 so that the lever 148 is rotated in the clockwise direction. Rotation in the clockwise direction serves to rotate the feeler arms 140 against the force of their associated springs 156 so as to clear the fillers 146 from any of the lugs 142. The wheels are now free to be set into motion by the control motor 60 as described and then stopped at the apprpriate times by the stop mechanism described. During the run and stop portion of the game cycle the cam follower 150 is maintained in its counterclockwise position as shown in FIG. 9 because it is now riding on the rise portion of the feeler cam 152. After the wheels have been stopped the cam 152 has been rotated to the point where the cam follower 150 no longer engages the rise portion of that cam so that the springs 156 are then effective to rotate the feeler arms 140 in the counterclockwise direction as shown in FIGS. 7 and 8. Each feeler arm moves in the indicated direction until its motion is limited by engagement with a lug 142. Thus the feeler arms by virtue of their different angular positions provide an indication of the combination of symbols appearing in the straight viewing line referred to.

At the beginning of a cycle of operation the various elements are positioned as shown in FIGS. 5 and 7. As the control motor 60 begins to turn it, therefore, first causes the feeler arms 140 and their associated feelers to be moved to a reset position. Very shortly after this the cam follower 82 moves past the offset 80 so that the wheels are put into motion by the action of the coil spring 96. Just before this point in time the elements are disposed as is shown in FIG. 8. After the wheels have been put into motion the stop levers are effective to stop the wheels in the sequence described and after the wheels are stopped the feelers are moved to engagement with one or the other of any of the stops 42 on the star plates.

An important feature of the device as thus far described is the provision of means whereby it may easily be assembled and disassembled for manufacturing and servicing purposes. To this end the side wall 34 is formed with slots 170, 172 and 174 while the side wall 36 is formed with corresponding slots 176, 178 and 180. Each corresponding pair of slots provide a means whereby a shaft may be easily mounted in or removed from the device. Thus, slots 170 and 176 are aligned to receive the wheel shaft 42 and its bearing structure. Once mounted in its slots the wheel shaft and wheels may be held in position by straps 182 and 184 secured to the side walls by screws as shown. Likewise the feeler arm shaft 144 may be mounted in the device by inserting it in the slots 174 and 180 and holding it and its bearing structure in place by means of the straps 186 and 188. The drive shaft 70 mounted in the device by means of the slots 172 and 178 while the stop lever bar 114 is mounted by inserting it in a pair corresponding recesses 190 and 192 extending downwardly from the slots 172 and 178. In this fashion all of the major assemblies, the wheels, the drive shaft, the feeler arms and the stop mechanism may be assembled externally to the device itself and then mounted in the device. In the event that it should ever be necessary to replace or repair a component the subassembly of which that component is part may be easily removed from the device and replaced when repaired.

In an electrical control system for operating the control motor indicating that a coin or token has been inserted so that a game may be played and providing an indication of whether or not a player has won and to what extent that player has won is shown in FIGS. 10A through 10G.

FIGS. 10B through 10G illustrate a circuit arranged to be supplied from a different current source through the busses 194 and 196. Connected across these busses are the various relays, their contacts and switches as will be described. For ease of explanation these elements will be described in conjunction with an explanation of a sequence of play.

A sequence of play is begun by inserting a coin or token into the slot 14. The device may be provided with means well known in the art for testing the coin or token for size, weight and material before permitting it to pass and rejecting it if it is not proper. If the coin or token is proper it operates a coin switch to open its normally closed contact 200A annd close to normally open contact 200B. Upon the closure of contact 200B a coin relay will be actuated by energizing its coil 202. Upon actuation the coin relay will lock itself in by closing its cntacts to complete a circuit from bus 194 through a normally closed switch 204 to bus 196. Thus, the coil 202 will remain energized until the switch 204 is opened, which will occur upon a circumstance to be subsequently described. At the same time the coin relay locks itsef in through contact 202A, it also closes a contact 202B. After the coin leaves the coin switch so that the contacts 200A and 200B revert to their normal position a circuit is provided from bus 194 through now closed contacts 200A and 202B, a normally closed contact 206A operated by a lock solenoid, the operating coil of which is 206, and a normally closed conntact 208A operated by initial coin relay, the operating coil of which is designated as 208 to a coins played unit having a reset coil 210. This circuit energizes the coil 210 causing the coins played unit to reset to zero. The coins played unit may be constituted by stepping switch having reset coil 210 and a step up coil 216.

The zero position of the coins played unit completes a circuit through a switch, through a set of contacts 212 to energize the coil 208 of the initial coin relay. That relay when energized locks itself in through one of its own contacts 208B, one side of which is connected through a normally closed switch 252A which, as will be seen is arranged to be operated by the control motor 60.

Further, upon operation of the initial coin relay 208 it opens its contact 208A and closes its contct 208C. When this occurs the coins played reset coil 210, will be deenergized while the lock solenoid coil 206 will be energized through the contact 208C. Upon the energization of coil 206 the contact 206A is opened while a normally opened contact 206B is closed. The closure of contact 206B is effective to energize the step up coil 216 in the coins played unit and that unit is advanced to its first position. The switch 204 is a part of the coins played unit and upon the advancement of the coins played unit by virtue of the energization of the coil 216 the switch 204 is opened as is the switch 212. The opening of the switch 204 breaks the lock in circuit of the coin relay 202 and the circuit of the initial coin relay 208. At this time the handle 22 may be pulled by the player to commence a game cycle or additional coins may be inserted in order to increase the winning score of the player in the event a combination of symbols, after the wheels have been spun and stopped, constitute a winning combination.

In the event the player wishes to exercise the latter option he inserts another coin or token, and once again operates the coin switch 200A and 200B to energize the coin relay 202 again. As before, the coin relay will lock itself in through the contacts 204 and 202A until the coins played unit step up coil 216 is once again energized. As before, when the coin leaves the coin switch the coins played unit step up coil 216 will be energized. However, the coins played unit reset coil 210 will not be energized because the contacts 206A and 206B operated by the handle solenoid were previously operated so as to open 206A and close 206B when the initial coin was inserted. When the coin unit step up coil 216 is operated again the switch 204 opens and breaks the lock in circuit of the coin relay 202, and at this time the coins played unit is advanced to the second position.

Once again the player has an option of inserting more coins or tokens or pulling te handle to commence a game cycle. It is contemplated in this particular embodiment of the invention that as many as five coins may be played and each time the operation would be repeated. Upon the insertion of the last coin an insert coin light 218 connected through a resistor 220 a normally closed switch 222, a normally closed switch 224 operated by the handle 22, and a switch 248B operated by the control motor 60 is extinguished by the opening of the switch 222 forming a part of the coins played unit and opened by that unit when the last permitted coin has been played. This provides a visual indication to the player notifying him that no more coins can be accepted. At the same time the switch 222 is effective to interrupt a circuit to a coin lockout coil 226 situated in the coin receiving mechanism so that the device acts positively to refuse any more coins returning the same to the player.

As soon as the handle 22 is operated it immediately opens the contacts 224 deenergizing the coin lockout relay coil 226. At the end of the travel of the handle the handle lock assembly was mechanically latched back to its lockout position and its associated switches 206A through 206C are returned to their normal positions.

At the end of the handle stroke a switch 228 (see FIG. 10E) is closed completing a circuit through a contact 208D which had been previously closed when the initial coin relay coil 208 was energized and connected to the switch via a conductor 230 to energize the coil 232 of a spin relay operating a contact to cause the control motor 60 to run. The spin relay locks itself in through a contact 232A which is likewise connected to the conductor 230.

The device now enters a play sequence as described. The control motor 60 is rotated, rotating the drive shaft 70 and almost immediately releasing the "cocked" spring 96. The wheels are spun and stopped as described. After the last wheel comes to a stop the cm 152 operates the feeler arms 140 to cause the feelers 146 to rotate until stopped by one of the lugs 142. Connected to each feeler arm 140 is a feeler wiper 234 which comes to rest with one of a plurality of contact strips 236 on each side of a printed circuit board 238 mounted between the side walls 34 and 36, one for each feeler arm and disposed to be engaged by its associated feeler wiper. In this manner an electrical circuit is provided to determine if the combination appearing on the designated line is a winning combination and also the extent to which it is a winning combination.

Figure 6:
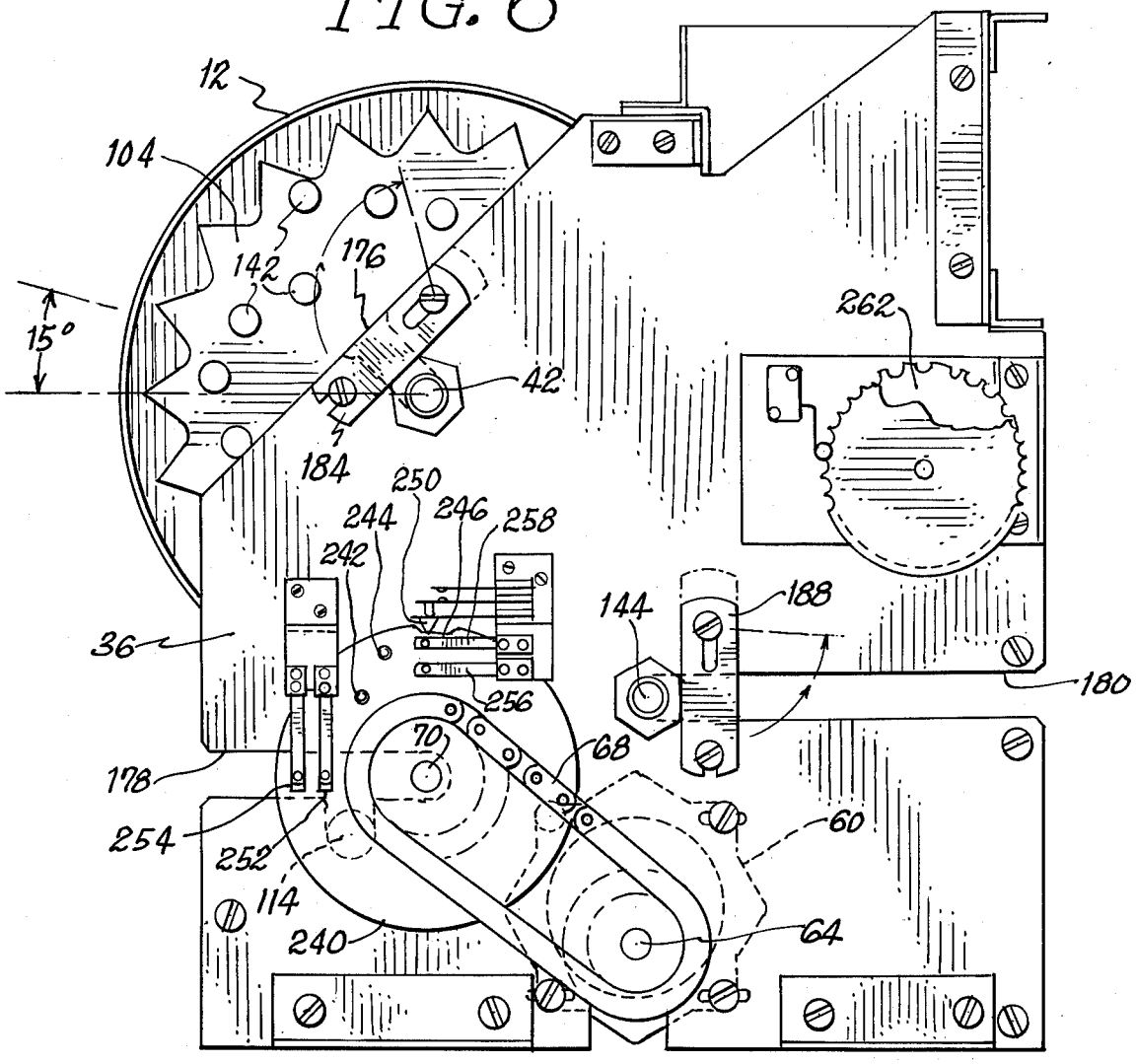
FIG. 6 is the opposite side view of the embodiment of FIG. 3.

Referring now to FIGS. 4 and 6, it may be seen that in addition to the mechanical cams previously described, the device includes a cam 240 secured to the drive shaft 70 so as to rotate therewith and operating switches that control a sequence of electrical events. The cam 40 is constituted by a disc having a pair of studs 242 and 244 projecting therefrom. In addition, the periphery of the disc is provided with a recess 246 and also acts as a caming surface. A first switch operated by the cam 240 is designated 248 and includes a pair of normally open contacts 248A and a pair or normally closed contacts 248B. This switch is operated by an actuator 250 which in the zero position of the cam is riding in the recess 246. A second switch is designated 252 and is positioned to be operated by the lug 242 after that lug has rotated 45°. A third switch is designated 254 and is positioned to be operated by the stud 244 after that lug has rotated 60°. The switch 252 includes a pair of make and break contacts 252A and 252B as does the switch 254. A fourth switch is designated 256 and it is positioned to be operated by the lug 242 after that lug has rotated 330 degrees. A fifth switch 258 is positioned to be operated by the lug 244 after thaat lug has rotated 335°. It should be understood that the particular arrangements and operation sequence and specification as to operation sequences are by way of exemplification only for a designer may find other timing intervals more desirable under certain circumstances.

The first event to occur when the control motor 60 is energized is for the switch 248 to operate because its actuator 250 has ridden out of the recess 246. The normally open contact 248A is closed to permit operation of the control motor 60 for one cycle of play. A normally closed contact 248B is opened to cause the coin lockout relay 226 to drop out (see FIG. 10B). After the cam has rotated 45 degrees the switch 252 is operated opening its contact 252A and closing its contact 252B. The effect of this switch operation is to energize a player's readout reset coil 260 and a pay out counter reset coil 262. Coil 260 when energized sets a player's readout circuit back to zero while the coil 262 when energized sets a pay out counter back to zero. The contact 252A when opened interrupts the circuit to the initial coil relay 208 causing that relay to drop out. When the initial coil relay drops out its contacts 208D are opened interrupting the circuit to the conductor 230 to cause the spin relay to drop out.

Figure 10A:
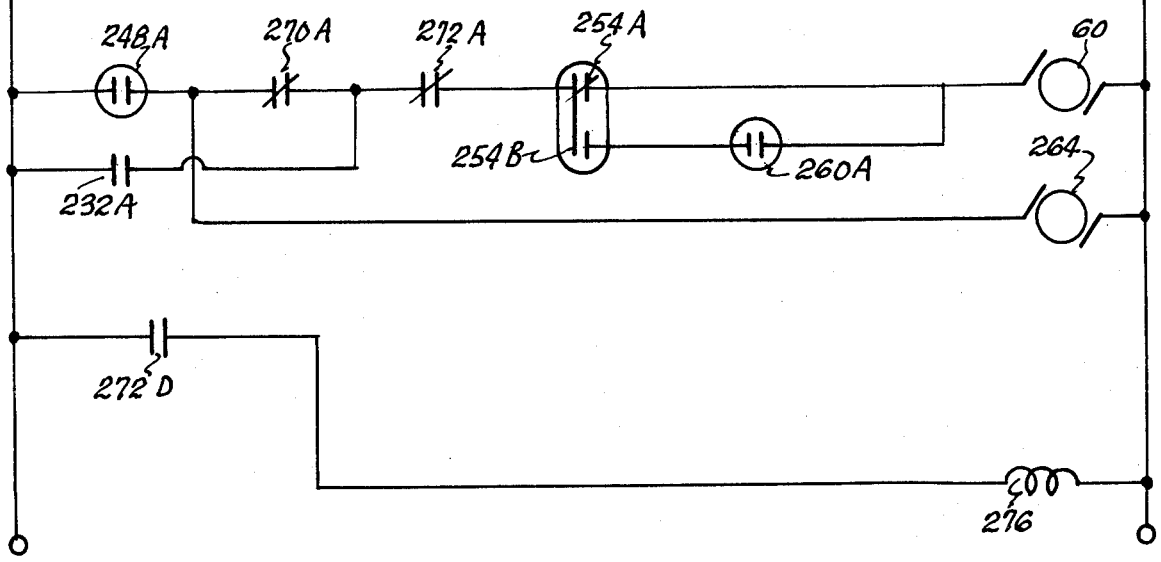
FIGS. 10A through 10G are schematic illustrations of an electrical control circuit forming a part of the invention.
Figure 10B:
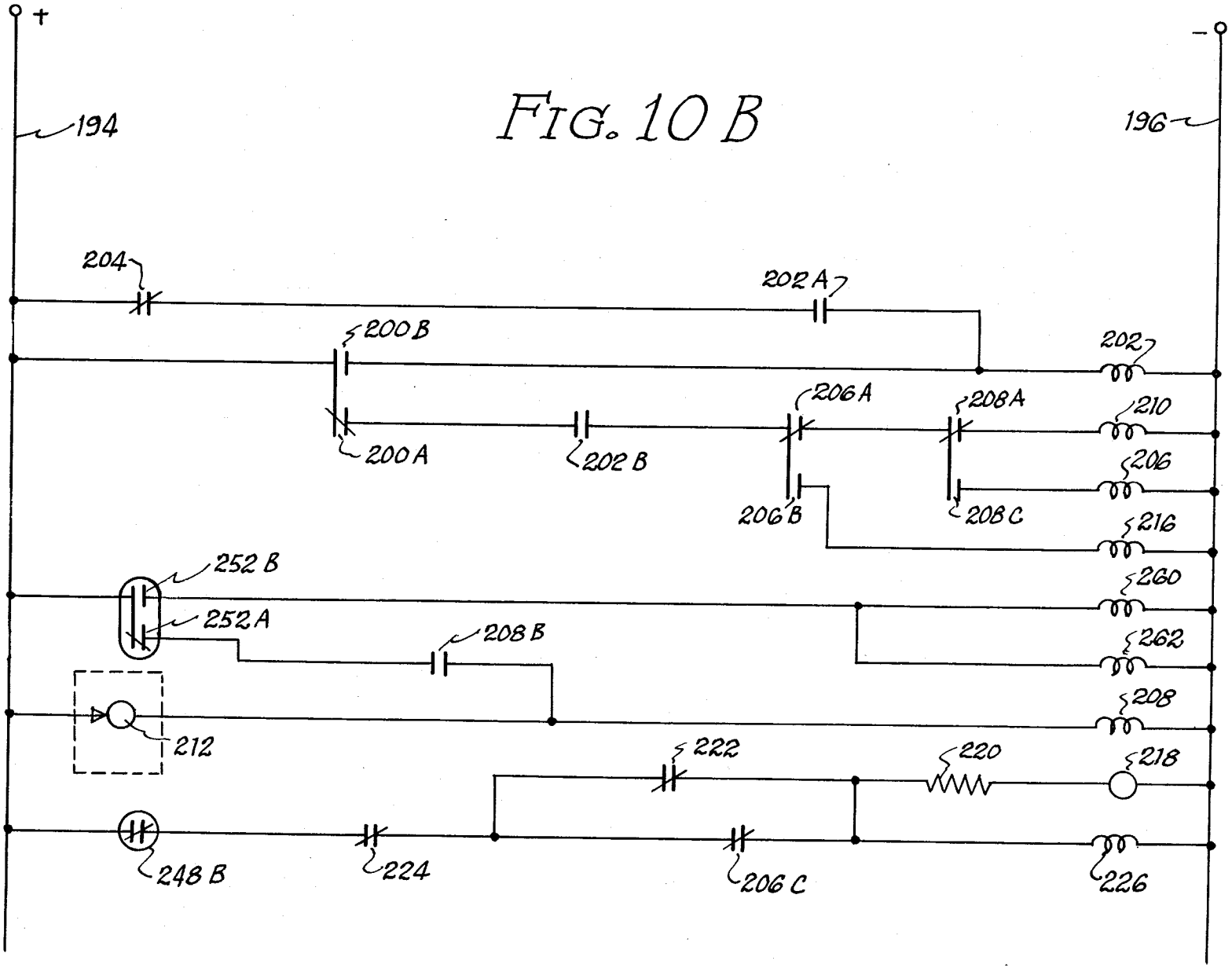
Figure 10C:
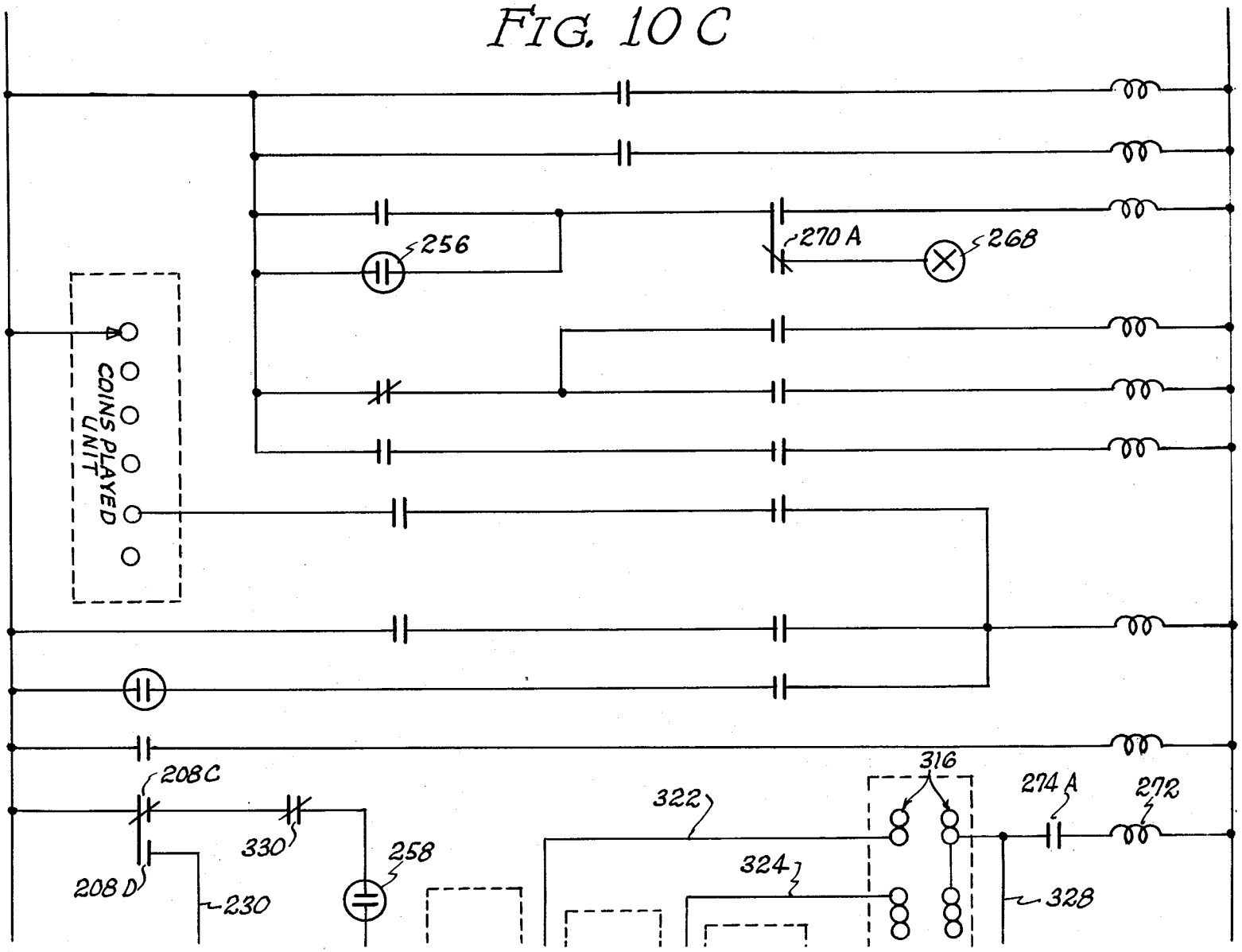

After the cam 240 has operated 15 degrees more for a total of 60 degrees the switch 254 is operated (see FIG. 10A). The normally closed side 254A is opened causing the control motor 60 to stop. The normally open side 254B is closed and at some time later a contact 260A is closed. The contact 260A is part of a switch 260 operated by a cam 262 driven continuously by a timer motor 264. As may best be seen in FIG. 6 the cam 262 has irregularly spaced teeth, and as stated, rotates continuously at a fixed rate. Thus, after some variable time interval it will operate the switch 260 to restart the control motor 60. In this manner a variable time element is introduced so that the time during which the wheels are spun may vary from one play sequence to the next.

After the cam has rotated 330 degrees the lug 242 is effective to close the switch 256. The switch 256 when closed (see FIG. 10C) energizes a terminal 268 through the normally closed contact 270A of a relay 270. The terminal 268 activates a timer circuit shown in FIG. 10E. The fith switch 258 is operated by the lug 244 after the cam 240 has rotated 255 degrees and this switch (see FIG. 10C), if a circuit is complete through the feeler wipers 234 and the conductors 236 is complete, indicating a winning combination will cause a pay out relay 272 to be energized. When the safety timer, shown in FIG. 10F, was energized its output relay 274 was energized causing its contacts 274A and 274 to be closed. Therefore, with the contact 274A closed when the switch 258 is closed the pay out relay 272 picks up opening its contact 272A causing the control motor 60 to stop until the pay out is satisfied.

The timing cam 240 in conjunction with variator cam 262 therefor has caused a complete cycle of play to occur and has provided a variable time element in the wheel spinning portion of the cycle, and has stopped the operation of the device in the event a winning combination was achieved.

If a winning combination is present and the pay out relay 272 (FIG. 10C) is energized its contacts 272B, 272C and 272D are operated. When the contact 272D is closed a solenoid 276 is energized permitting a pay out to be made from a suitable coin dispensing device, the details of which form no part of this invention, and may be constituted by any one of a number of known devices. Such devices function to dispense coins and provide a count of the coins dispensed.

As the coins or tokens won are dispensed by the pay out device each coin or token operates pay out coin switch 278 (FIG. 10E) and which when closed energizes the coil 280 of a coin dispenser relay which includes contacts 280A and 280B. The first time relay 280 picks up its contact 280B is closed to operate a relay 282. The relay 282 upon operating closes a contact 282A to remain locked in. After the paid out coin has passed the switch 278 to permit it to open the relay 280 drops out but relay 282 remains locked in and it has closed a contact 282B so that the coil of a relay 284 picks up through now closed contact 280A. Relay 284 picking up locks itself in through its now closed contact 284A and now closed contact 282B.

When another coin is paid out switch 278 closes again to once again energize relay 280. With relays 242 and 284 now locked in the coil 286 of another relay is energized through closed contact 280B and a now closed contact 284B and locks itself in through its own now closed contact 286A and now closed contact 282A.

When relay 286 picks it closes its contact 286B to pick up a "2" relay 288 which locks itself in through a contact 288A. Once again when a coin operates switch 278 relay 280 is energized to close contact 280B and because relay 286 had earlier picked up and locked in its contacts 286C and 286D have operated so that a circuit is complete to cause a relay 290 to be energized. When relay 290 is operated its contact 290A is opened causing relay 282 to drop out. Relays 284 and 286 likewise drop because contacts 282A and 282B are now opened.

Figure 10D:
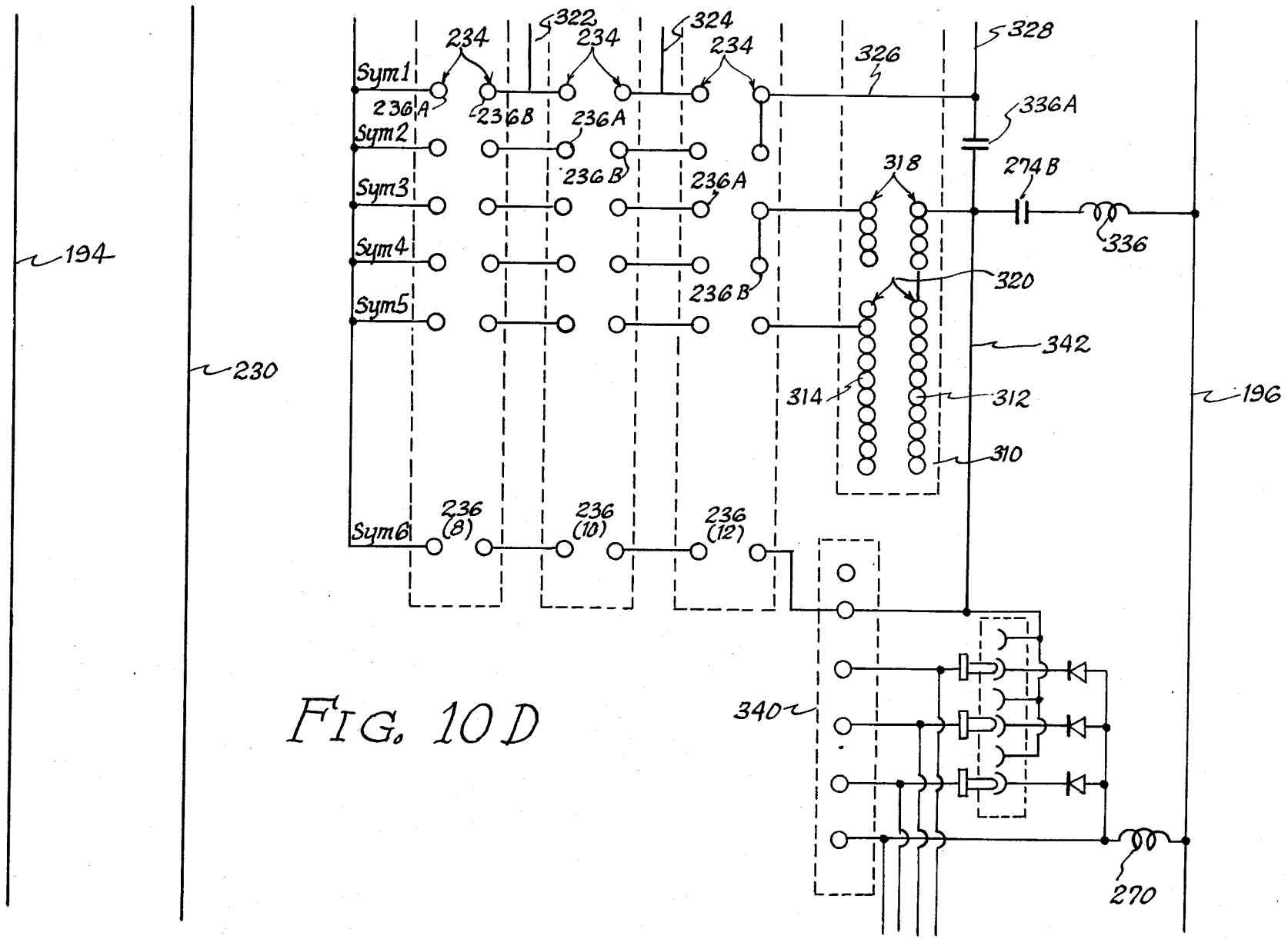
Figure 10E:
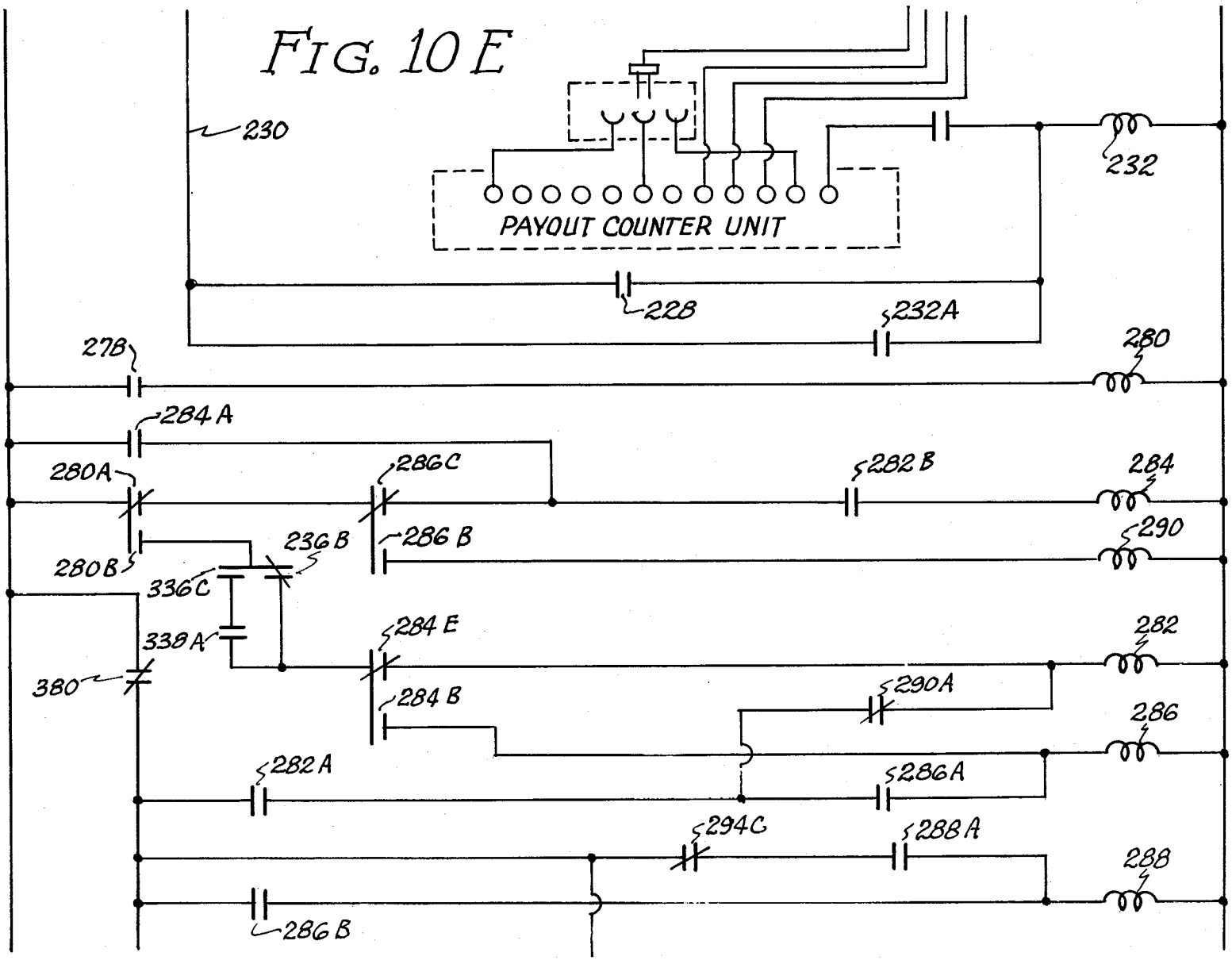

The sequence is then repeated with the third coin payed out. When the "2" relay 288 was energized it closed its contact 288B (FIG. 10F) and with contacts 282C and 284C closed a "3" relay 292 is energized. Relay 292 picking up locks itself in through its contact 292A and closes its contact 292B. When the fourth coin is payed out the sequence is the same as with the second coin and when relay 286 picks up again it closes its contact 286D to cause a "4" relay 294 to pick up. Relay 294 upon picking itself up locks itself in through its contact 294A, closes its contact 294B and opens its contact 294C (FIG. 10E). When contact 294C opens relay 288 drops out causing relay 286 to drop out whereby relays 282, 284 also drop out.

With the closure of cntact 294B a "5" relay 296 is energized to lock itself in through its contact 296A. A contact 296B of that relay is then effective to cause a pay out unit counter to be stepped up by energizing its coil 298. The counter is a conventional counter using a solenoid to advance it one count each time the coil 298 is energized. Associated with the counter mechanism is a normally closed end of stroke switch 300 (FIG. 10E). Thus, when the counter is stepped up at the end of the stroke the switch 300 is opened to open the lock in circuits to all of the relays causing them to drop out to permit a new cycle.

The relay system just described constitutes a divider network effective to cause the pay out counter to be advanced depending upon the number of coins played. In the sequence just described the network functioned to divide by 5, that is, to cause the pay out counter coil 298 to be pulsed once each time five coins were paid. This occurs when the player has played five coins and has caused the coins played unit step up coil 216 to be pulsed five times. When this occurred a movable contact 302 (FIG. 10F) in that unit was stepped so as to engage a contact 304 whereby contact 296B was effective to control the pay out counter coil 298. If only one coin had been played the contact 302 would have engaged a contact 306 so that a contact 282D of the relay would have been effective to pulse coil 298 so that the network would, therefore, divide by one. With each successive operation of the coil 216 the contact 302 is advanced in turn to the contacts 308, 310 and 312 so that one of the contacts 288C, 292C, 294C or 296C would be effective to operate the coil 298, thus making the network a divide by 2, 3 or 4 network.

The amount of the pay out is, of course, determined by the combination of symbols appearing on the wheels 8, 10 and 12 after they have stopped and the coins played.

It has earlier been described how the feelers 146 and their associated wipers 234 and contact strips 236 are used to provide an indication of the symbols appearing in a designated line after each wheel has stopped. By reference to FIGS. 10C and 10D it can be that each contact board 238 is provided with a plurality of spaced contact strips 236A on one cycle and a corresponding plurality of contact strips 236B on the other side. As may further be seen, the corresponding strips 236B on the board associated with wheel 8 are connected to the strips 236A on the wheel 10 while the strips 236B on the board associated with wheel 10 are connected to the strips 236A on the board associated with wheel 12.

Included in the pay out counter is a contact board 310 which has two rows of contacts 312 and 314 arranged so that successive corresponding contacts are connected as wipers 316, 318 and 320 are stepped each time the pay out counter step up coil 298 (FIG. 10F) is pulsed. Connections are provided from selected ones of the contact strips 236A and 236B to selected ones of the pay out counter contacts 314 to establish the amounts to be paid in accordance with various combinations of symbols.

In the illustrated embodiment a conductor 322 connects the contact strip 236B associated with wheel 8 to the second contact in the row 314. Likewise a conductor 324 connects the contact strip 236B to the third contact in the row 314. A conductor 326 connects the contact strip 236B associated with wheel 12 to a conductor 328 connected through the relay contact 274A to the pay out relay coil 272. Other connections are shown, it being understood that all such connections are shown, it being understood that all such connections are for purposes of exemplification only for they may be varied to alter the winning combinations of symbols and the amounts won by such winning combinations.

To illustrate assume that as symbol designated as symbol one of wheel 8 when it appears on the winning means that the player has won two coins. At the end of a cycle of the timing disc 240 has rotated to the point where switch 258 is closed and switch 274A is closed by the safety time relay 274. When the wheels stop the feeler arm 140 associated with wheel 8 moves forward so that its associated wiper 234 connects the contact strips 236A and 236B associated with symbol 1 on wheel 8 with each. This completes a circuit through closed contacts 208C, a set of closed contacts 330 provided on the pay out counter contact 236A, wiper 234, a contact 236B, conductor 322, a contact 314, wiper 316 to energize the pay out relay 272. As stated, relay 272 when energized operates its contacts 272A to stop the control motor 60 (see FIG. 10A) until the pay out is complete. Other contacts in the relay 272 may be used to control the pay out mechanism. As described, as each coin is paid out a pay out counter step up coil 298 is energized depending upon the status of the divider network as determined by the number of coins played. Each time the coil 298 is pulsed, therefore, the wipers 316, 318 and 320 are advanced to the next set of contacts in the rows 314 and 316.

Assuming one coin has been played and only symbol 1 is in the winning position one coil will be paid out and the coil 298 pulsed. This advances the wiper 316 to the next set of contacts in the rows 314 and 316 whereby the pay out relay 272 is continued to be energized. When the next coin is paid out the coil 298 is pulsed again and the wiper 316 advanced. With this last advance the circuit to the relay 272 will be broken causing that relay to drop out. In the event symbol 1 appears in a row on wheels 8 and 10 or 8, 10 and 12 a similar mode of operation occurs using the conductors 324 and 326. It is to be noted, however, that conductor 326 is not connected through any of the contacts 312 and 314. Thus, as each coin is paid out and relay 298 is pulsed the wiper 316 will be stepped past the contacts 312 and 314 until it reaches a position where it is effective to open contact 330 and thereby cause relay 272 to be deenergized.

The use of the divider network described permits a multiplication of a winning pay out in the event that more than one coin or token is played. A further multiplying circuit is provided when large pay outs are to be made to eliminate the necessity of a multiplication of relays in the divider network. This is constituted by a "Times 10" (X10) relay 336. Referring to FIG. 10D it may be seen that the relay 336 is conditioned by the closure of the contacts 274B in the safety timer relay 274 when a winning combination is present. If the winning combination is to yield a large pay out, for instance one resulting from the appearance of symbol 3 in a row on each of the wheels 8, 10 and 12, the wipers 234 in combination with the contacts 236A and 236B and wiper 318 complete a circuit to the relay 336 causing it to be energized. Upon energization of 336 it closes its contacts 336A to cause the pay out relay 272 to be picked up and operate as before. At the same time it operates its contacts 336B and 336C in FIG. 10E whereby the relay 282 can no longer be picked up through the contact 336B, but rather can only be picked up when a contact 338A in a stepping switch having an actuating coil 338 is closed each time ten coins are dispensed. As may be seen in FIG. 10F, the coil 338 is connected in series with contacts 336B of the relay 336 and is conditioned, therefore, when the relay 336 is energized. Connected in the same circuit are the contacts 280C of the relay 280 so that each time the contacts 280C are closed the coil 338 is pulsed. The relay 280 has been described (see FIG. 10E) is in series with the coin operated switch 278 and is energized each time a coin closes that switch. Therefore, when the coil 338 has been pulsed ten times its contacts 338 are closed permitting the operation of the divider network described by causing the energization of the relay 282. Thus, the X10 relay 336 in cooperation with the X10 step up coil 338 function to divide by 10 and thereby control the coin pay out.

In summary, the system shown and described is one wherein, depending upon the number of coins played, a divider network is effective to increase the coins paid out in the event of a winning combination. Further, a multiplying system is provided wherein the necessity for extending the divider network in the event of large pay offs is eliminated.

In the event the wheels 8, 10 and 12 stop at a point indicating that the player has won the maximum amount, as, for instance a presentation of symbol 6 in a row on all three wheels, a circuit is completed (see FIG. 10D) through the contacts 236A, 236B and the wipers 234 to the relay 270. This circuit is completed through the coins played unit 340 which is a stepping switch incrementing once for each coin played. When the relay 270 is energized it operates a set of contacts 270A in FIG. 10A to stop the control motor and also operates a set of contacts not shown to light a display means to provide an indication to an operator that the maximum prize has been won. It should be noted that the connections to the relay 270 are such that unless the maximum prize has been won because the maximum number of coins have been played and the winning combination of symbol 6 in a row has been achieved, that relay does not operate. Instead a circuit is established via a conductor 342 to operate the pay out control means through the relay 272 or the relay 336 as described.

Figure 10F:
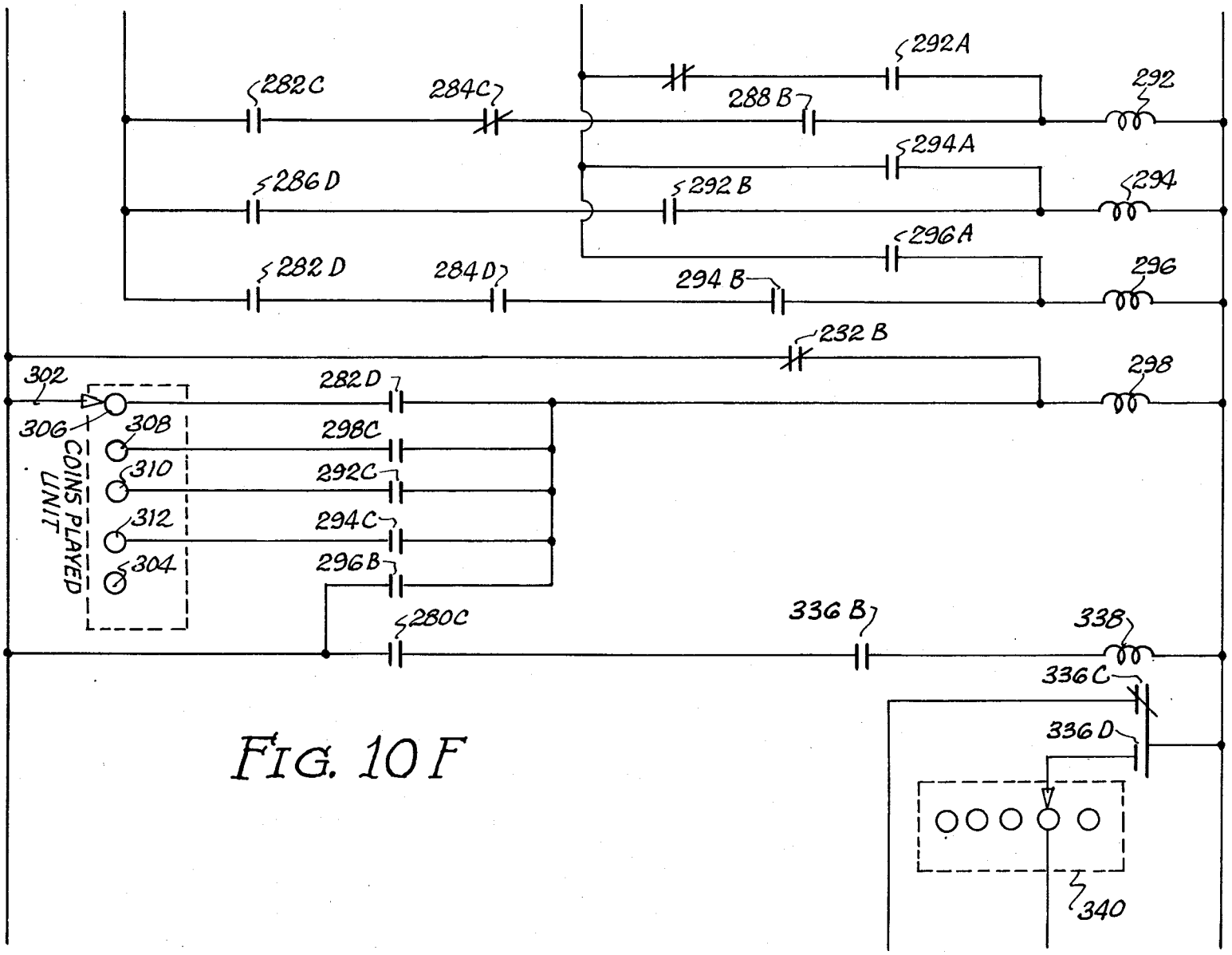
Figure 10G:
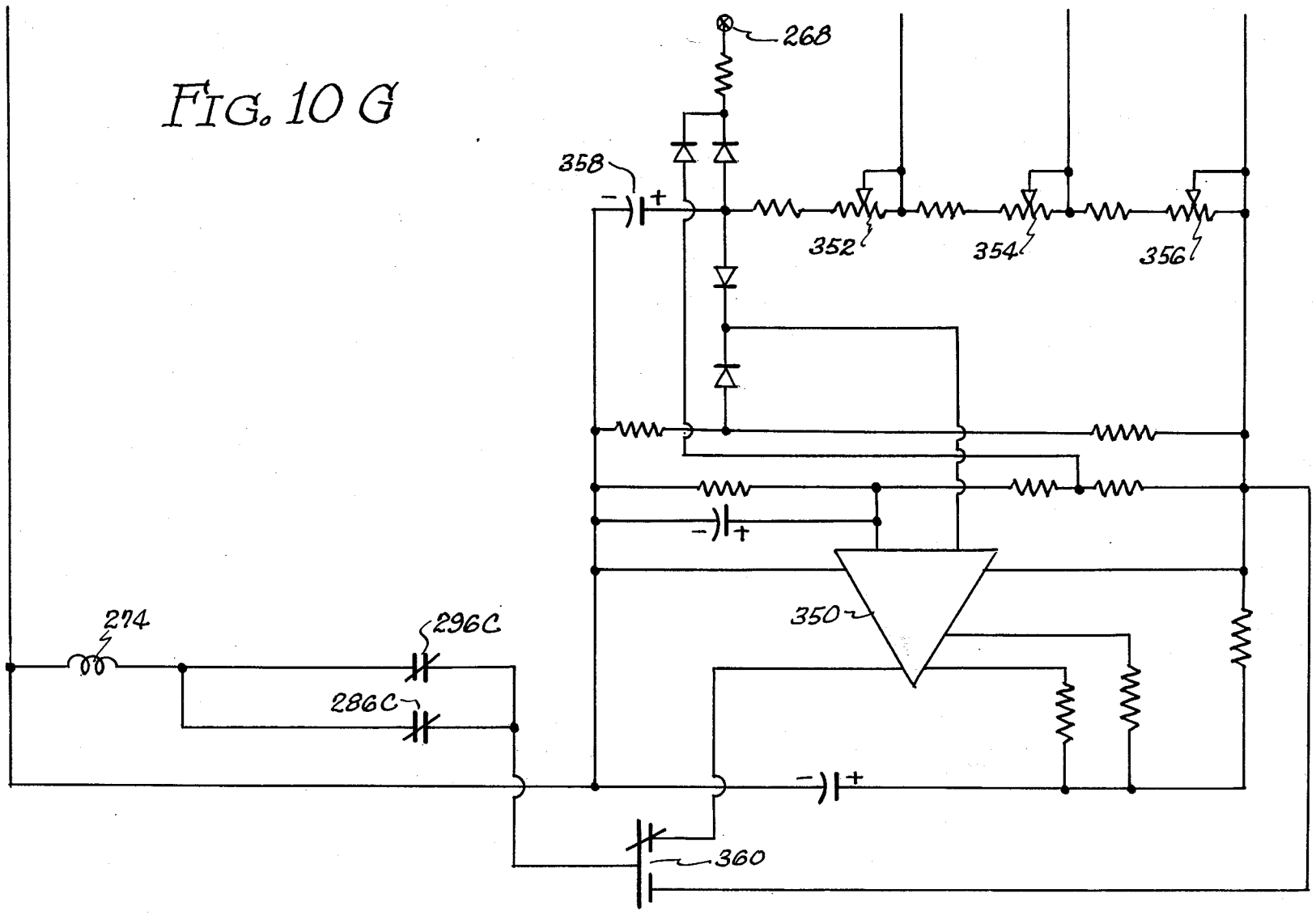

A safety timer is provided to become operative in the event of a malfunction anywhere in the pay out logic circuit (see FIGS. 10F and 10G). This circuit consists of an RC timing circuit including an amplifier 350 the output of which is used to operate the safety time relay 274. The safety timer is set so that if the pay out counter unit 298 is advancing at its predetermined rate the pay out logic that controls this rate is functioning normally. Because the pay out counter unit may be operating at different rates, depending upon the number of coins played, the timer is arranged to have a number of different timing cycles and these timing cycles are used to check on the predetermined advance rate of the pay out counter. If the pay out counter does not advance at its proper time the safety circuit will not operate and the safety timer relay 274 will be deenergized. The safety timer is supplied via the conductor 268 and includes three adjustable resistors 352, 354 and 356 connected to a capacitor 358 so as to provide an RC timing network. If a relatively small number of coins are to be paid out a circuit is completed to the resistor 352 through the normally closed contact 336C of the X10 relay 336, whereby a minimum timing interval is provided. If the pay out is such that the relay 336 operates the contact 336C is opened while the contact 336D is closed so that a greater timed interval is provided. As may be seen, the connection to the resistor 354 is through contacts on the coins played unit 340 and is, therefore, enabled when the required number of coins have been played. Included within the safety timer circuit is a service switch 360 which may be operated manually to continuously energize the safety timer through the contacts 296C of the relay 296 or the contacts 286C of the relay 286.

It is intended by the claims appended hereto to cover all modifications and variations as are included within their scope.

What is claimed as new and desired to be secured by Letters Patent is:

1. An amusement device comprising a rotatable wheel shaft, a plurality of wheels, one way clutches independently mounting each wheel on said wheel shaft whereby said wheels may be rotated in one direction when said shaft is rotated in that direction and are free to rotate in the same direction after said wheel shaft has stopped rotating, each wheel having a plurality of symbols appearing thereon, a plate mounted on each wheel and rotatable therewith, each plate having a plurality of stop means positioned thereon corresponding to various of said symbols on said wheels, a feeler shaft spaced from and coextensive with said wheel shaft, a plurality of feelers, one corresponding to each of said wheels mounted on said feeler shaft for rotation toward said wheel shaft and said stop means, means for stopping the rotation of each wheel sequentially, means for first restraining said feelers from rotation toward said wheel shaft and said stop means and then releasing them whereby said feelers may move into engagement with one of said stop means so that the angular position of each feeler provides an indication of the symbol on its associated wheel appearing in a particular straight line, electrical circuit means including a plurality of sets of contacts, means connected to each of said feelers for closing one pair of contacts in each set of contacts depending upon the angular position of the feeler, and said electrical circuit means including a control means connected to said sets of contacts and operative in the event the combination of symbols appearing in said particular straight line after said wheels have stopped rotating to provide an indication that a player has won.

2. The amusement device of claim 1, including a timing motor and means for rotating said wheel shaft in one direction comprising a crank arm on said wheel shaft, means biasing said crank arm in one direction, a drive shaft driven by said timing motor, a wheel cam having a surface of increasing radius and a drop off point mounted on said drive shaft for rotation therewith, a pivot lever pivotally mounted at one end and engaging said crankshaft at its free end, and a cam follower on said pivot lever engaging said wheel cam surface whereby as said wheel cam is rotated said pivot lever is rotated to move said crank arm in one direction against the force of its biasing means until said drop off point is reached and said pivot lever is released to permit said crank arm biasing means to rotate said crank arm in the other direction to thereby cause said wheel shaft and said wheels to be rotated.

3. The amusement device of claim 1, wherein said means for stopping said wheel ssequentially includes a stop shaft, a plurality of stop levers rotatably mounted on said stop shaft, means individually biasing said stop levers toward said wheels, a plurality of stop cams mounted on said drive shaft each individually associated with one of said stop levers and having rise portions of different lengths, a cam follower on each stop lever engageable with the rise portion of its associated cam and when so engaged being held away from each wheel against the force of its associated biasing means, whereby as said drive shaft is rotated and each stop lever cam follower rides off of its associated stop cam rise portion it will be free to be moved by its associated biasing means toward a wheel and engage a wheel plate to thereby stop the wheels in sequence.

4. The amusement device of claim 1, wherein each feeler has a biasing means connected thereto to urge its associated feeler toward said stop means, and wherein said means for restraining said feelers comprises a feeler cam having a surface of increasing radius and a drop off point mounted on said drive shaft for rotation therewith, a feeler crank mounted on said feeler shaft and engaging said feeler cam so that as said feeler cam is rotated said feelers are moved against the force of their associated biasing means away from said stop means and said wheel shaft until said feeler cam drop off point is reached, at which time said feeler biasing means are effective to rotate said feelers toward said wheel shaft and said stop means.

5. The amusement device of claim 1, including a timing cam mounted on said drive shaft for rotation therewith, a plurality of actuating lugs mounted on said timing cam, a plurality of switching devices mounted around said timing cam, and including switch actuators to be engaged at various times as said timing cam is rotated, electrical connections from one of said switch elements to said timing motor to cause said timing motor to be energized when said switch element is closed.

6. The amusement device of claim 5, including a second motor, a wheel mounted on said motor to be driven thereby, a plurality of variable pitched teeth formed on the periphery of said wheel, a switch element positioned adjacent said wheel, and having an actuator engageable by said variable pitched teeth so as to be opened and closed at random time intervals as said second motor is rotated, connections between said switch element and said timing motor to cause said timing motor to be operated at varying times, depending upon the condition of said switch element.

7. The amusement device of claim 6, wherein said electrical circuit means includes a plurality of relays, each relay having a plurality of contacts, a pair of normally open contacts in series with a first of said relays, said normally open contacts when closed causing said first of said relays to be energized, a normally open contact in said first of said relays connected in series with the operating coil of a second of said relays to energize said second of said relays when closed in response to the energization of the first of said relays, succeeding relays in said series of relays having normally open contacts connected in series with the energizing coils of other relays in said series whereby the energization of one relay in said series causes a succeeding relay in said series to be energized, a counter actuating coil, normally open contacts of the relays in said series of relays being connected in parallel with each other and to said counter actuating coil, a movable contact element selectively connected to one of said parallel connected contacts whereby said counter operating coil will be energized depending upon which of said parallel connected contacts is connected to said movable switch element and the relay coil controlling that contact is energized.

* * * * *